US005752573A

United States Patent [19]

Scott et al.

[11] Patent Number: 5,752,573

[45] Date of Patent: May 19, 1998

[54] EARTH-BORING BIT HAVING SHEAR-CUTTING ELEMENTS

[75] Inventors: Danny E. Scott, Montgomery; Rudolf Carl Otto Pessier, Houston, both of Tex.

[73] Assignee: Baker Hughes Incorporated, Houston, Tex.

[21] Appl. No.: 695,442

[22] Filed: Aug. 12, 1996

[51] Int. Cl.[6] ..... E21B 10/50

[52] U.S. Cl. ..... 175/374; 175/430

[58] Field of Search ..... 175/428, 430, 175/434, 374

[56] References Cited

U.S. PATENT DOCUMENTS

| | | | |
|---|---|---|---|
| 3,442,342 | 5/1969 | McElya et al. . | |
| 4,058,177 | 11/1977 | Langford Jr., et al. . | |
| 4,722,405 | 2/1988 | Langford Jr. . | |
| 5,172,777 | 12/1992 | Siracki et al. . | |
| 5,172,779 | 12/1992 | Siracki et al. . | |
| 5,201,376 | 4/1993 | Williams . | |
| 5,351,768 | 10/1994 | Scott et al. . | |
| 5,351,771 | 10/1994 | Zahradnik | 175/430 X |
| 5,421,424 | 6/1995 | Portwood et al. . | |

FOREIGN PATENT DOCUMENTS

| | | |
|---|---|---|
| 1086111 A | 4/1984 | U.S.S.R. . |
| 1216340 A | 7/1986 | U.S.S.R. . |

*Primary Examiner*—William P. Neuder
*Attorney, Agent, or Firm*—James E. Bradley

[57] ABSTRACT

An earth-boring bit has a bit body. At least one cantilevered bearing shaft depends inwardly and downwardly from the bit body and a cutter is mounted for rotation on the bearing shaft. The cutter includes a plurality of cutting elements, at least one of which has a generally cylindrical element body of hard metal. A pair of flanks extend from the body and converge to define a crest. The crest defines at least one sharp cutting edge at its intersection with one of the flanks.

14 Claims, 2 Drawing Sheets

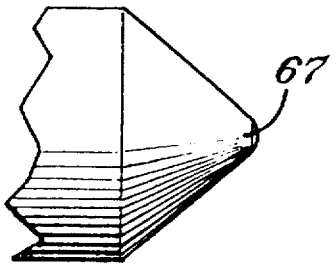
Fig. 2C PRIOR ART
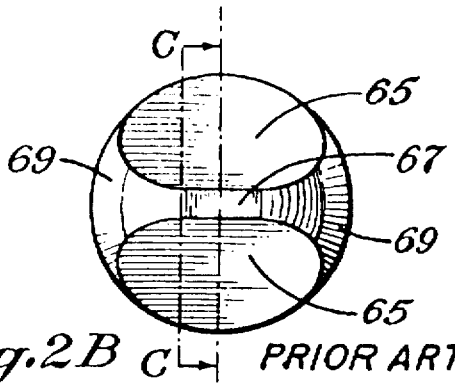
Fig. 2B PRIOR ART
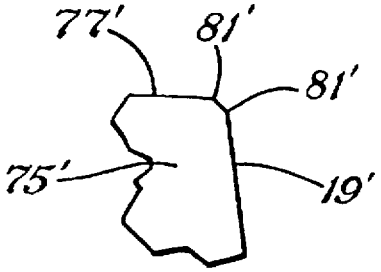
Fig. 4
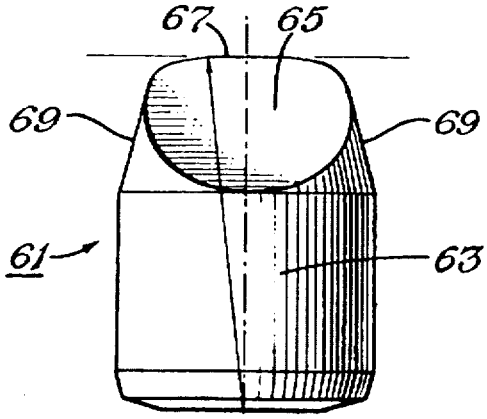
Fig. 2A PRIOR ART
Fig. 3D
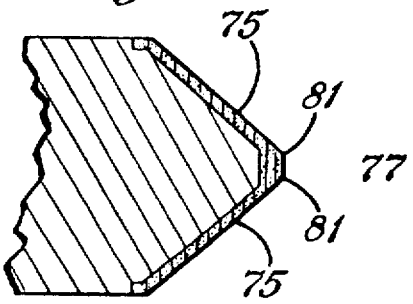
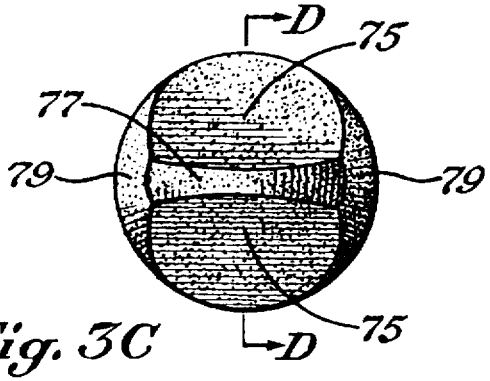
Fig. 3C
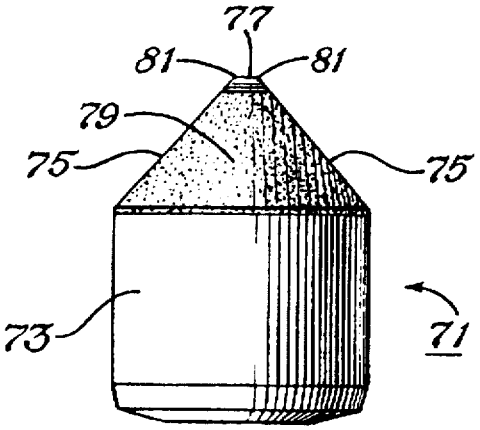
Fig. 3B
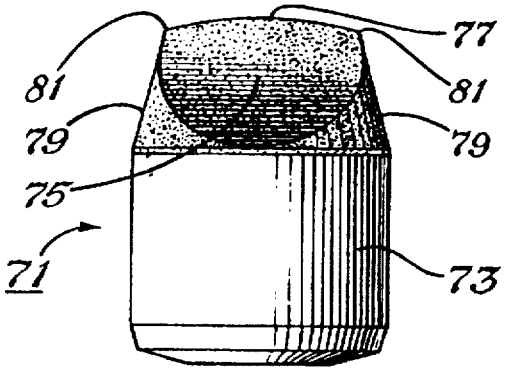
Fig. 3A

EARTH-BORING BIT HAVING SHEAR-CUTTING ELEMENTS

BACKGROUND OF THE INVENTION

1. Field of the Invention

The present invention relates to earth-boring bits of the rolling cutter variety. Specifically, the present invention relates to the cutting structure of earth-boring bits of the rolling cutter variety.

2. Background Information

The success of rotary drilling enabled the discovery of deep oil and gas reserves. The rotary rock bit was an important invention that made that success possible. Only soft formations could be commercially penetrated but with the earlier drag bit, but the original rolling-cone rock bit invented by Howard R. Hughes, U.S. Pat. No. 930,759, drilled the hard caprock at the Spindletop field, near Beaumont Tex., with relative ease.

That venerable invention, within the first decade of this century, could drill a scant fraction of the depth and speed of the modern rotary rock bit. If the original Hughes bit drilled for hours, the modern bit drills for days. Bits today often drill for miles. Many individual improvements have contributed to the impressive overall improvement in the performance of rock bits.

Rolling-cone earth-boring bits generally employ cutting elements on the cutters to induce high contact stresses in the formation being drilled as the cutters roll over the bottom of the borehole during drilling operation. These stresses cause the rock to fail, resulting in disintegration through near-vertical penetration of the formation material being drilled. When cutters are offset, their axes do not coincide with the geometric or rotational axis of the bit and a small component of horizontal or sliding motion is imparted to the cutters as they roll over the borehole bottom. While this drilling mode prevails on the borehole bottom, it is entirely different in the corner and on the sidewall. The corner is generated by a combined crushing and scraping action, while the borehole wall is produced in a pure sliding and scraping mode. In the corner and on the sidewall of the borehole, the cutting elements have to do the most work and are subjected to extreme stresses, which make them prone to break down prematurely, and/or wear rapidly.

In the past, cutting elements designed primarily for crushing have radiused, rounded intersections between element surfaces that are intended to minimize stress concentration in the element that can lead to element failure. Examples of such cutting elements are found in commonly assigned U.S. Pat. No. 3,442,342, May 6, 1969 to McElya et al., as well as U.S. Pat. Nos. 4,058,177 and 5,201,376.

Shear cutting is a disintegration mode that is not taken maximum advantage of in the rolling-cutter earth-boring bit field as it is in the fixed-cutter or drag bit field. Shearing formation material is the dominant disintegration mode in fixed-cutter or drag bits, which commonly employ super-hard, highly wear-resistant cutting elements to shear formation material at the bottom and sidewall of the borehole.

Commonly assigned U.S. Pat. No. 5,287,936, Feb. 22, 1994 to Grimes et al. discloses a shear-cutting gage cutting structure for earth-boring bits of the rolling cutter variety. U.S. Pat. No. 5,282,512 discloses cutting elements for a rolling cutter bit with diamond-charged elements on the forward and central zones of the cutting elements to enhance the shearing or scraping mode of formation disintegration. As shown by U.S. Pat. No. 5,287,936, the shearing mode of disintegration is particularly advantageous employed at the corner and the sidewall of the borehole, where the gage or diameter of the borehole is defined. Maintenance of a full gage or diameter borehole is important to avoid sticking of the bit or other components of downhole assemblies and to avoid the necessity of reaming operations to restore the borehole to the full gage or diameter condition.

Commonly assigned U.S. Pat. No. 5,351,768, Oct. 4, 1994 to Scott et al. discloses a scraper insert for more effective shear-cutting of the sidewall. Nevertheless, its crest or tip geometry is not sufficiently refined for optimum drilling efficiency and durability in harder, more abrasive rocks.

Commonly assigned U.S. Pat. No. 5,323,865, Jun. 28, 1994 to Isbell et al. discloses a chisel shaped heel insert for more effective disintegration of the borehole corner by enhancing the shear-cutting component. Again, the radiused edge lacks the sharpness to be an effective shear-cutting tool in harder, more abrasive rocks.

A need exists, therefore, for earth-boring bits of the rolling-cutter variety having cutting elements that take advantage of the shearing mode of formation disintegration with improved cutting edge geometries to provide the combination of drilling efficiency and durability.

SUMMARY OF THE INVENTION

It is a general object of the present invention to provide an earth-boring bit having cutting elements adapted for shearing engagement with the sidewall and corner having an enhanced edge geometry of the borehole in harder, more abrasive formations.

This and other objects of the present invention are achieved by providing an earth-boring bit having a bit body. At least one cantilevered bearing shaft depends inwardly and downwardly from the bit body and a cutter is mounted for rotation on the bearing shaft. The cutter includes a plurality of cutting elements, at least one of which has a generally cylindrical element body of hard metal. A pair of flanks extend from the body and converge to define a crest. The crest is the rake or cutting face of the cutting element and defines at least one sharp cutting edge at its intersection with at least one of the flanks.

According to the preferred embodiment of the present invention, the cutting edge, crest, and flanks of the cutting element are formed of super-hard material.

According to the preferred embodiment of the present invention, the hard metal is cemented tungsten carbide, and the super-hard material is polycrystalline diamond. According to a preferred embodiment of the present invention, a sharp cutting edge is defined at each intersection of the crest, flanks, and ends of the cutting element.

According to a preferred embodiment of the present invention, the intersection between the crest and flanks is a small chamfer.

DESCRIPTION OF THE DRAWINGS

FIGS. 2A–2C are elevation, plan, and partial longitudinal section views, respectively, of a prior-art chisel-shaped cutting element.

FIGS. 3A–3D are front elevation, side elevation, plan, and partial longitudinal section views, respectively, of a cutting element according to the present invention.

FIG. 4 is an enlarged section view, similar to FIGS. 2C and 3D, of the crest of a cutting element according to the present invention.

DESCRIPTION OF THE PREFERRED EMBODIMENT

Figure 1:
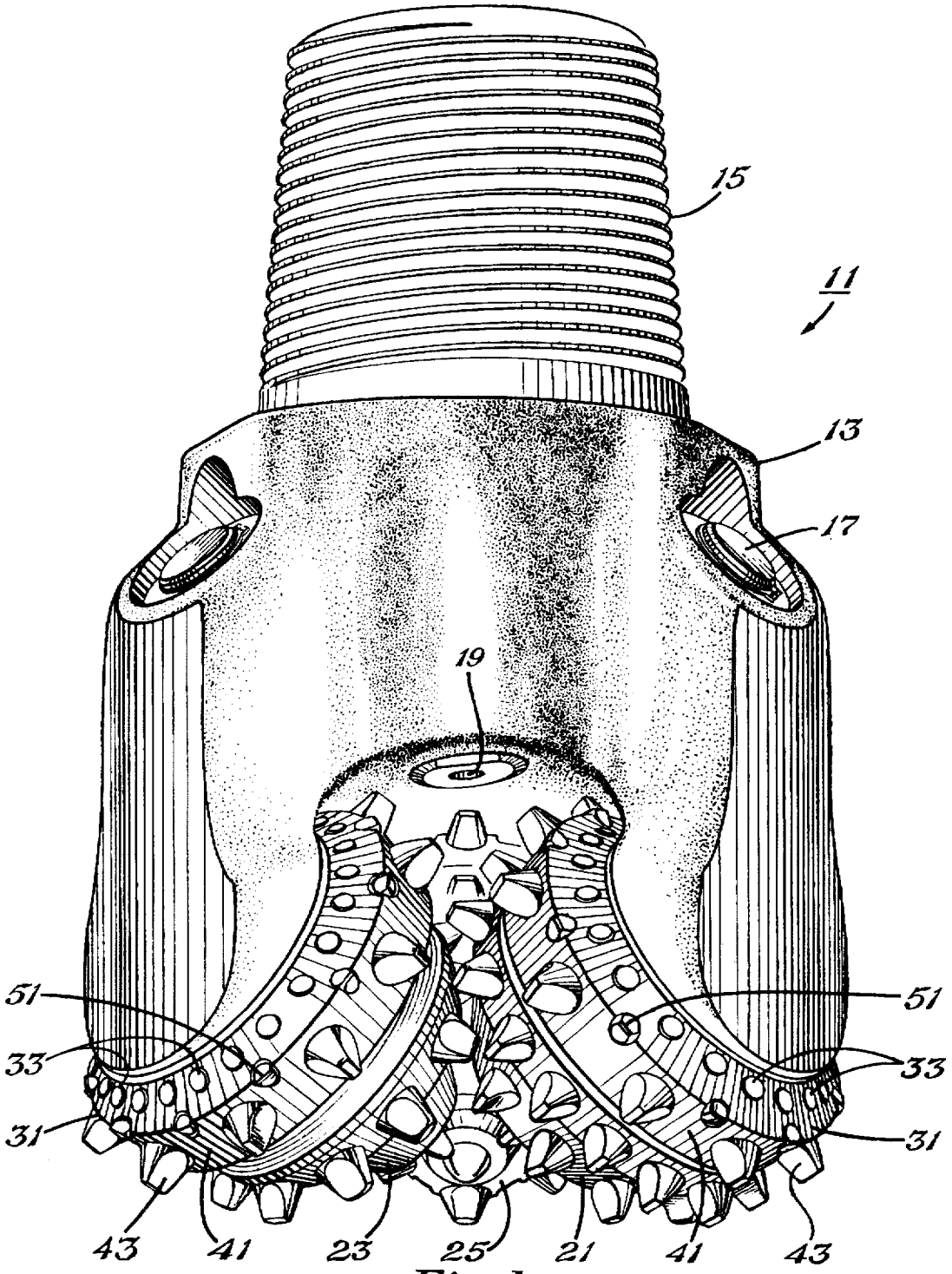
FIG. 1 is a perspective view of an earth-boring bit according to the present invention.

Referring now to the Figures, and particularly to FIG. 1, an earth-boring bit 11 according to the present invention is illustrated. Bit 11 includes a bit body 13, which is threaded at its upper extent 15 for connection into a drillstring. Each leg or section of bit 11 is provided with a lubricant compensator 17. At least one nozzle 19 is provided in bit body 13 to spray drilling fluid from within the drillstring to cool and lubricate bit 11 during drilling operation. Three cutters, 21, 23, 25 are rotatably secured to a bearing shaft associated with each leg of bit body 13. Each cutter 21, 23, 25 has a cutter shell surface including a gage surface 31 and a heel surface 41.

A plurality of cutting elements, in the form of hard metal inserts, are arranged in generally circumferential rows on each cutter. Each cutter 21, 23, 25 has a gage surface 31 with a row of gage elements 33 thereon. A heel surface 41 intersects each gage surface 31 and has at least one row of heel inserts 43 thereon. At least one scraper element 51 is secured to the cutter shell surface generally at the intersection of gage and heel surfaces 31, 41 and generally intermediate a pair of heel inserts 43.

The outer cutting structure, comprising heel cutting elements 43, gage cutting elements 33, and a secondary cutting structure in the form of chisel-shaped trimmer or scraper elements 51, combine and cooperate to crush and scrape formation material at the corner and sidewall of the borehole as cutters 21, 23, 25 roll and slide over the formation material during drilling operation.

FIGS. 2A–2C are elevation, plan, and partial longitudinal section views respectively, of a prior-art chisel-shaped cemented tungsten carbide cutting element 61. Element 61 comprises a cylindrical body 63, which is secured by interference fit into apertures in cutters 21, 23, 25 of bit 11. A pair of flanks 65 extend from body 63 and converge to define a crest 67. A pair of ends 69 connect flanks 65 and crest 67 to cylindrical body 63. To avoid fracture and spalling of the hard metal of which element 61 is formed, the intersections of crest 67 with flanks 65 and ends 69, and crest itself 67, are rounded or radiused to avoid stress concentrations leading to high point or contact stresses and failure of the cutting element.

FIGS. 3A–3D are front elevation, side elevation, plan, and partial longitudinal section views, respectively, of a cutting element according to the present invention. Cutting element 71 is particularly adapted to be used as a scraper or trimmer element (51 in FIG. 1) or as a heel cutting element (43 in FIG. 1). Cutting element 71 comprises a cylindrical body 73 formed of hard metal, preferably cemented tungsten carbide. A pair of flanks 75 extend from cylindrical body 73 and converge at about 45° to define a crest 77. A pair of ends 79 connect crest 77 and flanks 75 to cylindrical body 73.

As best seen in FIGS. 3A, 3B, and 3D, the intersections of crest 77 with flanks 75 and ends 79 defines four sharp cutting edges 81. According to the preferred embodiment of the present invention, an angle of about 135 degrees is included at the intersections between crest 77 and flanks 75. Sharp cutting edges 81 are formed by grinding or otherwise flattening crest 77. If the crest is formed of super-hard material, electric-discharge machining (EDM) processes may be preferred to establish sharp cutting edges 81. Otherwise, conventional grinding is preferred for cemented tungsten carbide and similar hard metals. This is to be contrasted with the prior-art practice of rounding or radiusing these intersections to avoid stress concentrations.

According to the preferred embodiment of the present invention, at least crest 77 and flanks 75 of elements 71 are formed of super-hard material, preferably polycrystalline diamond. Super-hard materials approach or equal diamond in hardness and include natural diamond, polycrystalline diamond, thermally stable polycrystalline diamond, thin-film diamond, thin-film diamond-like carbon, cubic boron nitride, and other materials generally exceeding 3500 to 5000 on the Knoop hardness scale. Super-hard materials can be formed on hard metal substrates using high-temperature, high-pressure processes, such as those disclosed in U.S. Pat. Nos. 3,913,280 and 3,745,623.

FIG. 4 is a longitudinal section view, similar to FIGS. 2C and 3D, depicting another embodiment of the present invention in which the intersection of crest 77' with flanks 75' is a small 45° chamfer 0.010" wide and 0.007" deep. The chamfer eliminates surface imperfections at the single sharp cutting edge and thus makes the two cutting edges 81' that are less prone to premature failure than the near-orthogonal intersections of the embodiments of FIGS. 3A–3D. Additionally, there is more material backing up two cutting edges 81' than the single cutting edge 81 because of the greater included angle at the intersections of the chamfer with the crest and flank.

It has been found that the sharp cutting edge(s) 81, 81' produced by grinding crest 77 results in a more durable and more efficient cutting element for the heel and outer regions of cutters (21, 23, 25 in FIG. 1) than conventional radiused crest 67. Generally speaking, cutting elements on the inner rows of cutters (toward the apex of the cone) tend to operate predominantly in the crushing mode. The cutting elements on the outer rows, e.g. the heel and gage rows (41 and 51 in FIG. 1), tend to operate predominantly in the sliding and scraping mode, in which sharp cutting edges effectively slice the formation and achieve disintegration by inducing shear stresses, similar to conventional metal-cutting tools.

The earth-boring bit according to the present invention possesses a number of advantages. A primary advantage is that the earth-boring bit is provided with more efficient and durable cutting elements.

The invention has been described with reference to preferred embodiments thereof. It is thus not limited, but is susceptible to variation and modification without departing from the scope and spirit of the invention.

We claim:

1. An earth-boring bit comprising:

a bit body;

at least one cantilevered bearing shaft depending inwardly and downwardly from the bit body;

a cutter mounted for rotation on the bearing shaft, the cutter including a plurality of cutting elements;

at least one of the cutting elements having:

a generally cylindrical element body of hard metal;

a pair of flanks extending from the body and converging to define a crest, the crest defining at least one sharp cutting edge at an intersection with one of the flanks.

2. The earth-boring bit according to claim 1 wherein the cutting edge, crest, and flanks are formed of super-hard material.

3. The earth-boring bit according to claim 2 wherein the hard metal is cemented tungsten carbide, and the super-hard material is polycrystalline diamond.

4. The earth-boring bit according to claim 1 wherein a sharp cutting edge is defined at each intersection of the crest and flanks.

5. The earth-boring bit according to claim 1 wherein a chamfer is formed at the intersection of the crest with the flanks, the chamfer defining two sharp cutting edges.

6. An earth-boring bit comprising:

a bit body;

at least one cantilevered bearing shaft depending inwardly and downwardly from the bit body;

a cutter mounted for rotation on the bearing shaft, the cutter including a plurality of cutting elements;

at least one of the cutting elements having:

a generally cylindrical element body of hard metal;

a pair of flanks extending from the body and converging to define a crest, the crest being formed to define sharp cutting edges at each intersection of the crest and flanks.

7. The earth-boring bit according to claim 6 wherein the cutting edge, crest, and flanks are formed of super-hard material.

8. The earth-boring bit according to claim 6 wherein the hard metal is cemented tungsten carbide, and the super-hard material is polycrystalline diamond.

9. The earth-boring bit according to claim 6 further comprising:

a pair of ends connecting the flanks and crest, the sharp cutting edges defined as each intersection of the crest, flanks, and ends.

10. The earth-boring bit according to claim 6 wherein a chamfer is formed at the intersections of the crest with the flanks, the chamfer defining two sharp cutting edges.

11. An earth-boring bit comprising:

a bit body;

at least one cantilevered bearing shaft depending inwardly and downwardly from the bit body;

a cutter mounted for rotation on the bearing shaft, the cutter including a plurality of cutting elements;

at least one of the cutting elements having:

a generally cylindrical element body of hard metal;

a pair of flanks extending from the body and converging to define a crest, and a pair of ends connecting the flanks, the crest defining four sharp cutting edges at intersections with the flanks and ends.

12. The earth-boring bit according to claim 11 wherein the cutting edge, crest, and flanks are formed of super-hard material.

13. The earth-boring bit according to claim 11 wherein the hard metal is cemented tungsten carbide, and the super-hard material is polycrystalline diamond.

14. The earth-boring bit according to claim 11 wherein a chamfer is formed at the intersections of the crest with the flanks, the chamfer defining two sharp cutting edges.

* * * * *